US010054390B1

(12) United States Patent
Hane

(10) Patent No.: US 10,054,390 B1
(45) Date of Patent: Aug. 21, 2018

(54) APPARATUS, KIT AND METHOD FOR A BLANK-ONLY MACHINE NON-FIREARM

(71) Applicant: Michael Hane, Zieglerville, PA (US)

(72) Inventor: Michael Hane, Zieglerville, PA (US)

( * ) Notice: Subject to any disclaimer, the term of this patent is extended or adjusted under 35 U.S.C. 154(b) by 0 days.

(21) Appl. No.: 15/873,104

(22) Filed: Jan. 17, 2018

Related U.S. Application Data

(60) Provisional application No. 62/447,509, filed on Jan. 18, 2017.

(51) Int. Cl.

| | |
|---|---|
| ***F41B 11/89*** | (2013.01) |
| ***F41A 33/04*** | (2006.01) |
| ***F41A 21/10*** | (2006.01) |
| ***F41A 21/28*** | (2006.01) |
| *F42B 8/04* | (2006.01) |

(52) U.S. Cl.
CPC ..... *F41B 11/89* (2013.01); *F41A 21/10* (2013.01); *F41A 21/28* (2013.01); *F42B 8/04* (2013.01)

(58) Field of Classification Search
CPC ..... F41B 11/89; F41A 33/04; F41A 21/00
USPC ..... 42/54, 57; 434/18, 16, 21; 89/14.5, 29
See application file for complete search history.

(56) References Cited

U.S. PATENT DOCUMENTS

| | | | | |
|---|---|---|---|---|
| 4,128,040 | A * | 12/1978 | Schuetz | F41A 21/26 89/14.5 |
| 7,581,954 | B2 * | 9/2009 | Schavone | F41B 11/51 124/74 |
| 7,926,405 | B2 * | 4/2011 | Ducastel, Jr. | F41A 9/46 89/29 |
| 8,764,446 | B2 * | 7/2014 | Landies | F41A 33/00 434/11 |
| 8,770,978 | B2 * | 7/2014 | Botten | F41A 33/04 434/16 |
| 9,303,938 | B2 * | 4/2016 | Hiscock | F41A 21/12 |
| 9,593,911 | B2 * | 3/2017 | Jones | F41A 5/18 |
| 9,777,981 | B1 * | 10/2017 | Bower | F41A 33/04 |
| 2008/0229642 | A1 * | 9/2008 | Hu | F41B 11/64 42/54 |

* cited by examiner

*Primary Examiner* — Reginald S Tillman, Jr.
(74) *Attorney, Agent, or Firm* — Robert J. Yarbrough; Lipton, Weinberger & Husick

(57) ABSTRACT

A blank-only machine non-firearm includes a replica shell and replica barrel from a non-firing replica machinegun, such as an airsoft replica machinegun. An insert that defines a receiver may be inserted into and contained within the interior volume of the replica shell. An exhaust gas barrel is attached to the receiver and extends within the replica barrel. The replica receiver and barrel are configured to fire blank cartridges and not to fire live rounds. Noise and flash from a firing blank cartridge is directed from a chamber defined by the receiver to the exhaust gas barrel and hence to the replica barrel.

20 Claims, 13 Drawing Sheets

APPARATUS, KIT AND METHOD FOR A BLANK-ONLY MACHINE NON-FIREARM

I. RELATED APPLICATIONS

This application is entitled to priority from U.S. Provisional Patent Application 62/447,509 filed Jan. 18, 2017. Application 62/447,509 is hereby incorporated by reference as if set forth in full herein.

II. BACKGROUND OF THE INVENTION

A. Field of the Invention

The Invention is an apparatus, kit and method for constructing a replica machinegun capable of firing only blank cartridges. The invention, kit and method of the invention utilize a shell and barrel of a non-firing replica machinegun to define the outward appearance of the blank-only machine non-firearm. The blank-only machine non-firearm cannot fire live rounds and cannot be converted readily into an operational machinegun capable of firing live rounds.

B. Statement of the Related Art

As used in this application, a 'non-firearm' is a replica machinegun that is not and cannot readily be made capable of firing live rounds. A 'non-firearm' is not classified as a 'firearm' by the U.S. Bureau of Alcohol, Tobacco and Firearms and does not suffer any of the barriers to ownership and use of an actual machinegun.

World War II reenactors are hobbyists who recreate aspects of the historical events or period of World War II. A World War II reenactor may wear period uniforms and other clothing, may carry or use period equipment and weapons, may eat period food and may listen to period music. One U.S. military weapon that is popular with World War II reenactors is the "United States Submachine Gun, Cal. 45, M3A1," referred to as the 'grease gun' due to its resemblance to the mechanic's tool. The M3A1 submachine gun was developed during 1942 as a replacement for the Thompson submachine gun and was widely used throughout World War II. Actual M3A1 submachine guns are not practical for re-enactor use due to the high value of the surviving weapons and due to the hurdles of government regulation of machine gun ownership, transportation and use.

Airsoft toy replicas of the M3A1 submachine gun are popular with World War II re-enactors. Airsoft toys guns generally are replica firearms that are configured to fire BB-like plastic pellets. Airsoft toy guns generally are powered by a spring-loaded piston or by compressed gas. Airsoft toy guns may be very accurate external reproductions of actual firearms and may be difficult to distinguish from the actual firearms by external appearance. The body of the actual M3A1 submachine gun was constructed of stamped steel for quick, inexpensive construction. This stamped steel construction makes the actual M3A1 submachine gun a particularly successful subject for airsoft toy replica firearms.

Airsoft toy guns are not firearms. An airsoft toy replica M3A1 submachine gun is not capable of firing either blank cartridges or live rounds. A World War II reenactor who carries an airsoft M3A1 submachine gun does not experience the weight, noise, muzzle flash, and ejected cartridge cases of an actual M3A1 submachine gun.

As used in this document, the term 'blank cartridge' means a cartridge that includes a case, a primer inserted into the base of the case and an explosive charge inside the case, but that does not include a bullet. The front end of a blank cartridge case may be shaped to simulate the shape of a live round with a bullet. When a firing pin strikes the primer, the impact detonates shock-sensitive material contained within the primer. Flame from the detonating shock-sensitive material travels through a hole penetrating the blank cartridge case to the inside of the case, where the flame ignites the explosive charge. The resulting noise and flash may resemble the noise and flash resulting from firing a live round.

As used in this document, the term 'live round' means a cartridge having a case, primer and explosive charge contained within the case, and also including a bullet disposed at the front end of the case. When a live round is loaded into an actual firearm and the primer is struck with the firing pin, the detonating primer ignites the explosive charge. The expanding gas from the explosive charge drives the bullet down the barrel.

III. BRIEF DESCRIPTION OF THE INVENTION

The Invention is a replica M3A1 submachine gun, such as an airsoft toy replica, that is converted so that the converted replica is capable of firing blank cartridges, is not capable of firing live rounds and cannot be modified to fire live rounds. The replica M3A1 submachine gun of the Invention is classified as a 'non-firearm' by the U.S. Bureau of Alcohol, Tobacco and Firearms. The invention is also a kit for converting a replica M3A1 submachine gun to a blank-only automatic non-firearm and is a method of converting the replica M3A1 submachine gun to the blank-only machine non-firearm.

The converted replica M3A1 submachine gun has a similar weight and feel to an actual M3A1 submachine gun. The converted replica is capable of automatic fire, like the actual M3A1 submachine gun. The converted replica produces a muzzle flash and ejects spent blank cartridges in a manner similar to the actual M3A1 submachine gun. The converted replica also provides recoil that is similar to the actual M3A1 submachine gun. The converted replica provides World War II reenactors and collectors of replica firearms a much more realistic experience than a conventional airsoft toy or other replica M3A1 submachine gun.

Although the current application is illustrated and described in terms of an M3A1 submachine gun, the apparatus, kit and method of the Invention apply to any replica machinegun and not only to a replica M3A1 submachine gun.

The Actual M3A1 Submachine Gun

The actual M3A1 submachine gun includes a generally cylindrical receiver that also defines the external appearance of the firearm. A cylindrical bolt is configured to slide on guide rods within the receiver assembly. The bolt is urged toward the front of the receiver assembly by springs. A barrel is in threaded engagement with the front end of the receiver assembly. When a user depresses the trigger of the actual M3A1 submachine gun, a sear released the cocked bolt, which moved forward in the receiver due to the urging of the springs. The face of the moving bolt strips a live round from the magazine and presses the live round into the chamber at the breech of the barrel. The chamber stops the live round. The momentum of the moving bolt causes the firing pin at the bolt face to crush the primer of the live round, firing the live round and propelling a bullet down the barrel. The resulting recoil pushes the bolt toward the rear end of the receiver. The bolt face grips the spent cartridge case and the rearward motion of the bolt removes the spent cartridge case from the chamber. As the cartridge case moves rearward and clears the chamber, an ejector dislodges the cartridge case from the bolt face and propels the cartridge case through the ejection port. If the user releases the trigger, the sear stops the bolt in the rearward (cocked) position. If the user continued to depress the trigger, the sear does not restrain the bolt and the bolt again moves in the forward direction under the urging of the springs, repeating the firing process until all of the live rounds in the magazine are expended.

The Invention

The Invention is a blank-firing machine non-firearm disguised by and incorporating the replica shell and replica barrel of a replica machinegun. In this case, the replica is an airsoft toy and is a replica of an actual M3A1 submachine gun. The replica shell and replica barrel of the airsoft toy provides the shell for the invention and provides the outward appearance of the actual M3A1 submachine gun. An insert is enclosed within the replica shell and replica barrel and defines the receiver, bolt assembly, chamber and exhaust gas barrel. A magazine containing blank cartridges engages a modified magazine well of the replica shell and is configured to feed blank cartridges to the insert. A trigger assembly is attached to the shell and features a sear that controls the operation of the bolt in a manner similar to that of an actual M3A1 submachine gun.

While the Invention is described as applied to an airsoft toy replica M3A1 submachine gun, the features of the Invention may be applied to other airsoft toy submachine guns or to other toy or replica machine guns, whether or not those replica machine guns are airsoft toys.

Like the actual M3A1 submachine gun, the bolt of the Invention slides within the receiver and is guided by rods. Springs urge the bolt toward the front of the receiver. When the bolt is in a rearward, or cocked, position and a user pulls the trigger, a sear releases the bolt and the springs urge the bolt forward. The moving bolt strips a blank cartridge from the magazine and presses the blank cartridge into the chamber. The momentum of the bolt causes a firing pin to crush the primer of the blank cartridge, causing the blank cartridge to fire.

An exhaust gas barrel communicates with the front end of the chamber and extends in the forward direction within the replica barrel. The chamber is offset and is not aligned with the longitudinal axis of the exhaust gas barrel and replica barrel. Because the chamber and exhaust gas barrel are not aligned, a live round in the chamber cannot fire a bullet down the exhaust gas barrel and through the replica barrel.

The exhaust gas barrel is in fluid communication with the chamber. When the replica barrel assembly is in engagement with the replica shell, the replica barrel assembly will completely enclose the exhaust gas barrel and hide the exhaust gas barrel from view. When the blank cartridge fires in the chamber, the exhaust gas travels from the chamber through the exhaust gas barrel and discharges at the muzzle of the replica barrel. The noise and muzzle flash from the firing blank cartridge emerges from the replica barrel, providing a realistic experience to the user. The use of the exhaust gas barrel in addition to the replica barrel prevents bursting or other over-pressure effects in the replica barrel, which is not designed or constructed to accommodate high pressures.

The recoil of the firing blank cartridge propels the bolt rearward. An extractor at the bolt face grips the spent blank cartridge case, removing the spent cartridge case from the chamber. When the moving spent cartridge case clears the chamber, a spring-loaded ejector propels the spent case from the from the bolt face and through an ejection port. The flying cartridge cases ejected from the ejection port also provide a realistic experience to the user.

The Invention Cannot Fire Live Rounds.

The Invention includes several features to prevent it from firing live rounds. First, the magazine of the Invention is sized to be too small to accept live rounds of the original caliber, even though the shell with the magazine installed has the appearance of an actual M3A1 submachine gun with an actual magazine installed. A magazine well insert installed in the magazine well of the shell prevents installation of an actual magazine of an actual M3A1 submachine gun. If the magazine well insert is removed, the magazine well of the Invention will not retain an actual M3A1 submachine gun magazine because the retaining mechanism for the actual magazine is not present.

Second, and as noted above, the misalignment between the chamber and the exhaust gas barrel prevents the Invention from firing live rounds.

Third, the bolt is not configured to press a live round from the magazine and into a chamber oriented along the longitudinal axis of the exhaust gas barrel. As a result, the bolt cannot be used to fire a live round.

The Invention Cannot be Converted to Fire Live Rounds.

The Invention also includes features that preclude a person from readily converting the Invention to fire live rounds by using parts from an actual M3A1 submachine gun. First, an actual M3A1 submachine gun bolt will not fit the receiver of the Invention because a boss occludes the opening in the shell in which the bolt must travel. If a person tried to install a bolt from an actual M3A1 submachine gun, the bolt could not fit because the boss would prevent its installation. The bolt from an actual M3A1 submachine gun also would not fit because the internal diameter of the receiver of the Invention is smaller than the diameter of the bolt of an actual M3A1 submachine gun—a bolt from an actual M3A1 submachine gun will not fit within the receiver.

Second, if a person attempted to convert the Invention to fire live rounds by removing the offset chamber and installing a barrel assembly from an actual M3A1 submachine gun, the person would not be able to attach the actual M3A1 barrel to the shell of the Invention because the threaded diameter of the shell where the replica barrel attaches is larger than the threaded diameter of the threads to which the actual M3A1 barrel is designed to engage. The actual M3A1 threaded barrel would not fit the threads of the shell.

Third, even if the person successfully replaced the bolt, chamber and exhaust gas barrel with parts from an actual M3A1 submachine gun, the replica of the Invention still would not fire a live round. The shell of the Invention is lengthened compared to the receiver of an actual M3A1 submachine gun so that the firing pin of the actual M3A1 submachine gun will not reach the primer of the live round in the chamber. The live round therefor cannot fire.

Although the above brief description is stated in terms of an M3A1 submachine gun, the features described to allow blank cartridges to be fired from the replica shell and replica barrel while preventing firing of live rounds and preventing ready conversion to fire live rounds apply equally to any replica machinegun.

III. BRIEF DESCRIPTION OF THE DRAWINGS

FIG. 2 also illustrates the appearance of the blank-only machine non-firearm of the Invention.

IV. DESCRIPTION OF AN EMBODIMENT

The Invention is a blank-only machine non-firearm 28 that is capable of fully automatic fire of blank cartridges, that will not fire live rounds, and that cannot be readily converted to fire live rounds. The Invention is also a kit and a method for converting an airsoft or other replica machinegun 26 into a blank-only machine non-firearm 28. The apparatus and method of the Invention apply to other replica machineguns 26 of different types and are not limited to an airsoft toy M3A1 submachine gun 26.

Figures 14, 15:
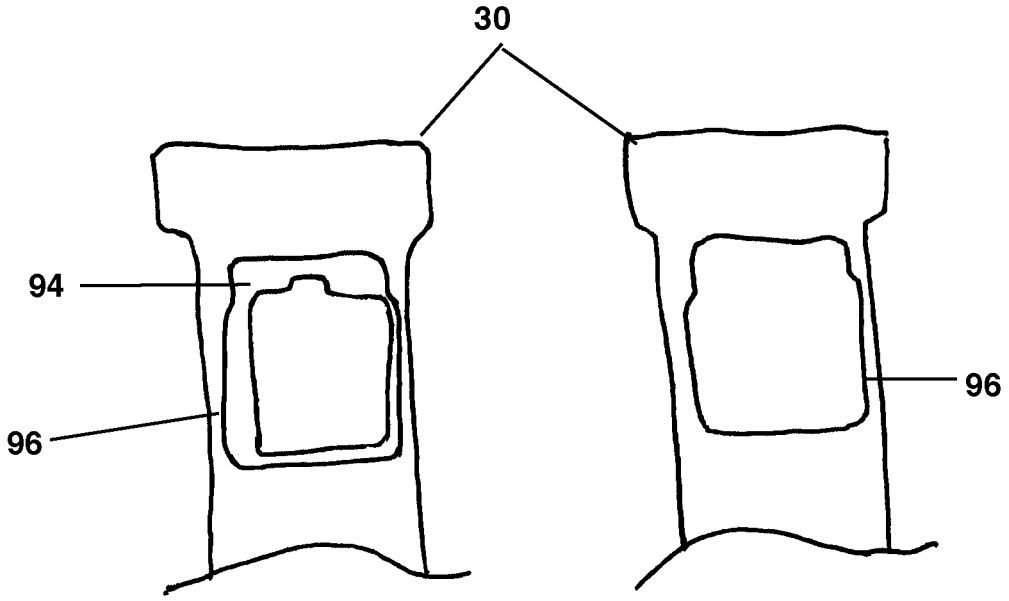
FIG. 14 is a detail bottom view of the replica shell showing the magazine well with the well insert.
FIG. 15 is a detail bottom view of the replica shell showing the magazine well without the well insert.
Figure 16:
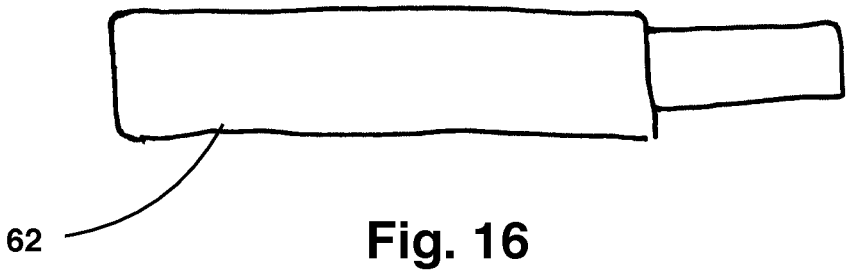
FIG. 16 is a side view of the blank-only magazine.

The Invention includes features to prevent firing of live rounds. The principal features are (a) misalignment between the chamber 64 and the longitudinal axis 86 of the exhaust gas barrel 40, (b) misalignment of the cartridge retaining assembly 68 with the longitudinal axis 86 of the exhaust gas barrel 86 that prevents the bolt 46 from holding a live round along the longitudinal axis 86, and (c) configuration of the magazine well 96 to prevent insertion of an actual M3A1 magazine 10 and to prevent loading live rounds through the magazine well 96. The misalignment of the chamber 64 and cartridge retaining assembly 68 with the exhaust gas barrel longitudinal axis 86 and replica barrel longitudinal axis 84 are discussed below with respect to FIGS. 7 and 9-12. The configuration of the magazine 62 and magazine well 96 is shown by FIGS. 14, 15 and 16.

In any blank-only automatic non-firearm 28, the risk of conversion of the Invention into a fully functional machine-gun capable of firing live rounds is a concern. The Invention includes several features to preclude ready conversion to a functional machinegun. To convert the Invention to fire live ammunition, a user would be required to change at least the replica barrel 32, the chamber 64, the bolt 46, the extraction and ejection mechanism of the cartridge retaining assembly 68, the magazine 62 and reconfigure the magazine well 96. The user also must overcome the effects of a boss 88, shown by FIG. 13, and must overcome limitations imposed by critical dimensions of the components of the Invention, some of which are described relating to FIG. 17 and all as described herein. A person seeking to convert the Invention to fire live ammunition effectively must build an entirely different firearm.

Figure 1:
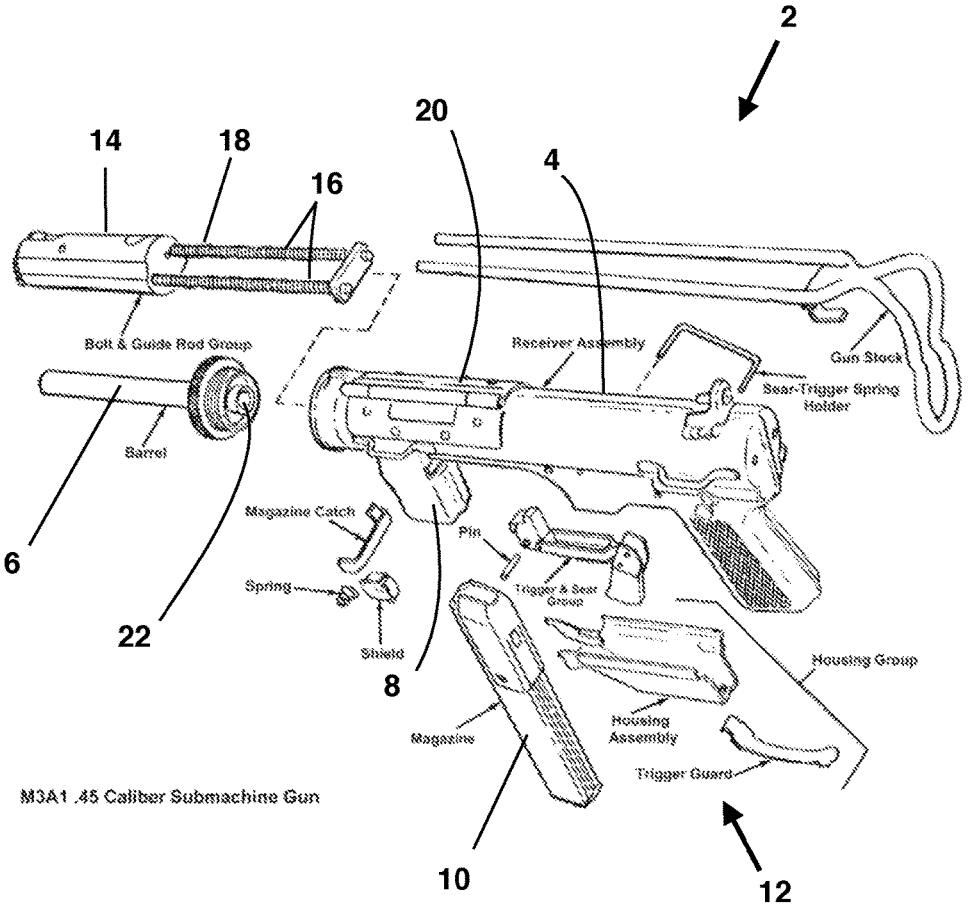
Prior Art Fig. 1
FIG. 1 is an exploded view of an actual M3A1 submachine gun.

FIG. 1 is an exploded view of an actual M3A1 submachine gun 2. The actual M3A1 submachine gun 2 featured a stamped steel actual receiver 4 that defines the outward appearance of the firearm. An actual barrel 6 is in threaded engagement with the front end of the actual receiver 4 and also defines the actual chamber 22. An actual magazine well 8 receives and retains an actual magazine 10 that holds live rounds. An actual bolt 14, actual guide rod 16 and actual spring 18 assembly are disposed within the actual receiver 2. The actual bolt 14 is configured for reciprocating motion within the actual receiver 2 and controlled by the actual guide rods 16. Actual springs 18 urge the actual bolt 14 to the front of the actual receiver 4.

From FIG. 1, the actual trigger assembly 12 selectably actuates an actual sear that releases the cocked actual bolt 14, causing the actual bolt 14 to move rapidly toward the front end of the actual receiver 4 under the force of the actual springs 18. As the actual bolt 14 moves toward the front end of the actual receiver 4, the actual bolt 14 strips a live round from the actual magazine 10 and pushes the live round into the actual chamber 22. The live round stops when fully chambered. The momentum of the moving actual bolt 14 causes the actual firing pin fixed to the actual bolt 14 to crush the primer of the chambered live round, causing the live round to fire and propelling a bullet down the actual barrel 6. The recoil of the firing live round propels the actual bolt 14 toward the back end of the actual receiver 4, compressing actual springs 16. The actual bolt 14 grips the spent live round case, pulling the case from the actual chamber 22. An actual ejector trips the spent case and propels the spent case through the actual ejection port and past the actual ejection port cover 20. The actual ejection port cover 20 also acts as a safety—when closed, the actual ejection port cover 20 interferes with the actual bolt 14, preventing the bolt 14 from moving forward and preventing the actual M3A1 submachine gun from firing. When the actual ejection port cover 20 is open, the actual ejection port cover 20 does not interfere with the actual bolt 14 and the actual M3A1 can fire.

Figure 2:
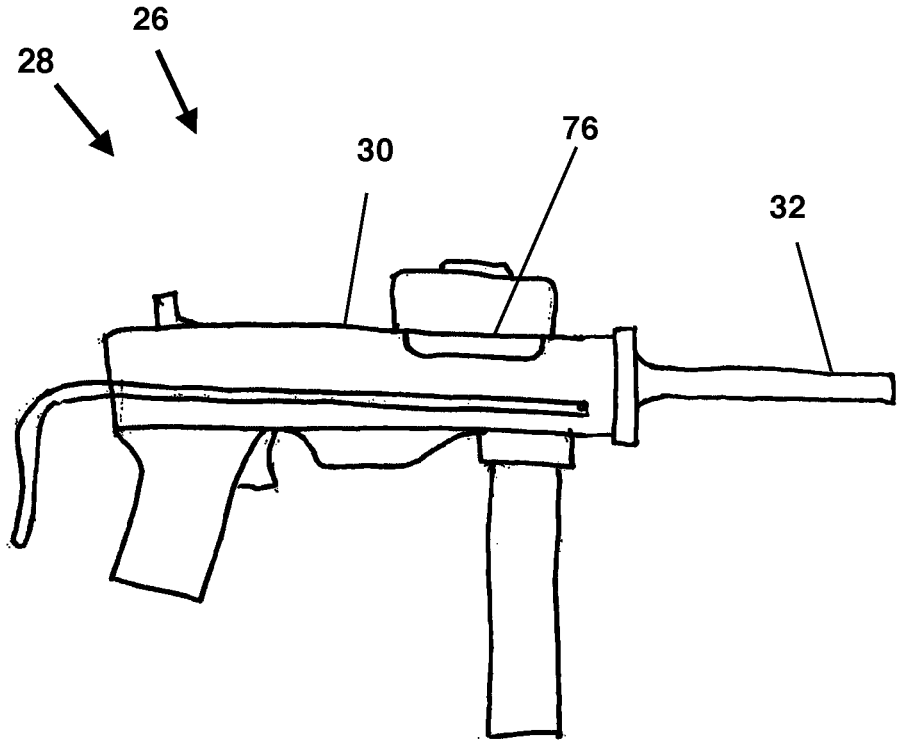
FIG. 2 is a side view of a non-firing toy replica M3A1 submachine gun.

FIG. 2 is an airsoft replica M3A1 submachine gun 26. The airsoft replica 26 is very similar in appearance to an actual M3A1 submachine gun 2 and to the blank-only machine non-firearm 28 of the Invention. The replica shell 30 of the airsoft replica 26 corresponds in appearance to the actual receiver 4 of the actual M3A1 submachine gun 2; however, the replica shell 30 is not an actual receiver 4 and is not capable of receiving the actual bolt 14, the actual magazine 10, a live round, or a blank cartridge.

Figure 3:
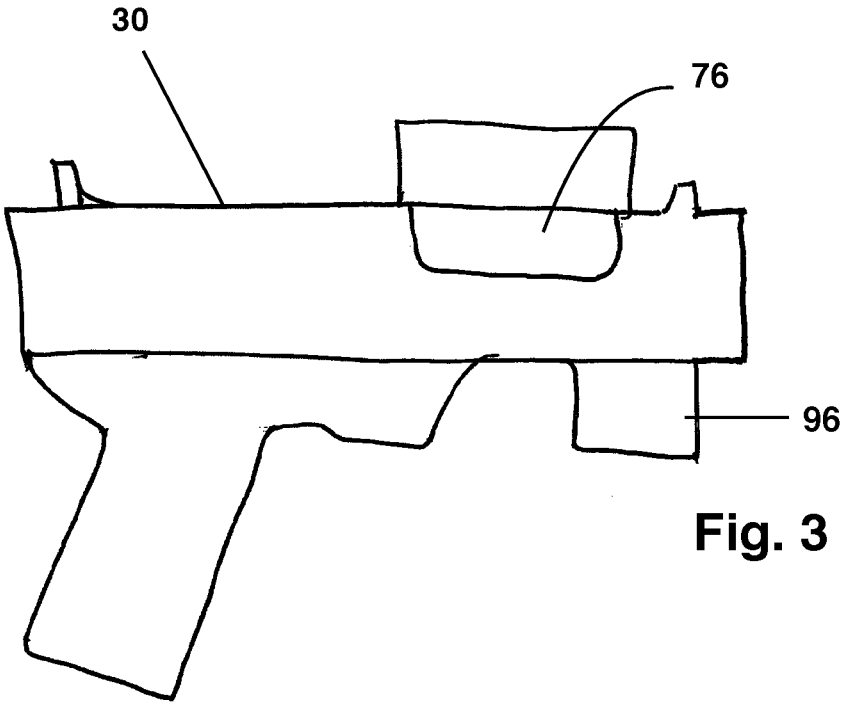
FIG. 3 is a side view of a replica shell.
Figure 4:
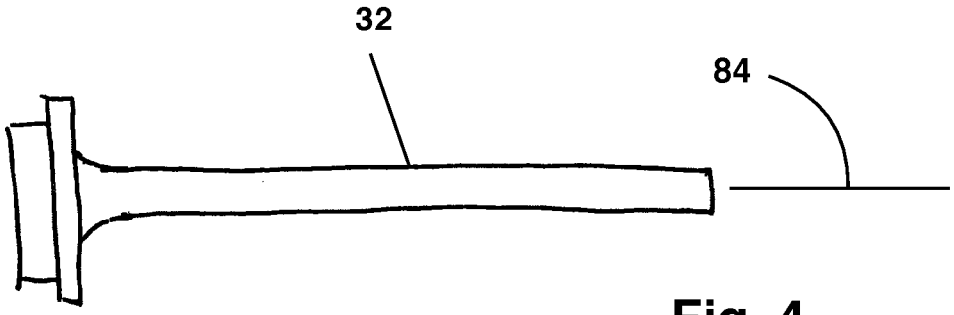
FIG. 4 is a side view of a replica barrel.

FIG. 3 shows the replica shell 30 stripped of its internal and external parts. FIG. 4 shows the replica barrel 32. For the airsoft replica M3A1 submachine gun 26, the replica barrel 32 and replica shell 30 are configured for threaded engagement. Any other mechanism for attaching a replica barrel 32 to a replica shell 30 is contemplated by the Invention. The replica shell 30 with the attached replica barrel 32, with the external parts attached, defines the external appearance of the blank-only machine non-firearm 28 of the Invention.

Figure 5:
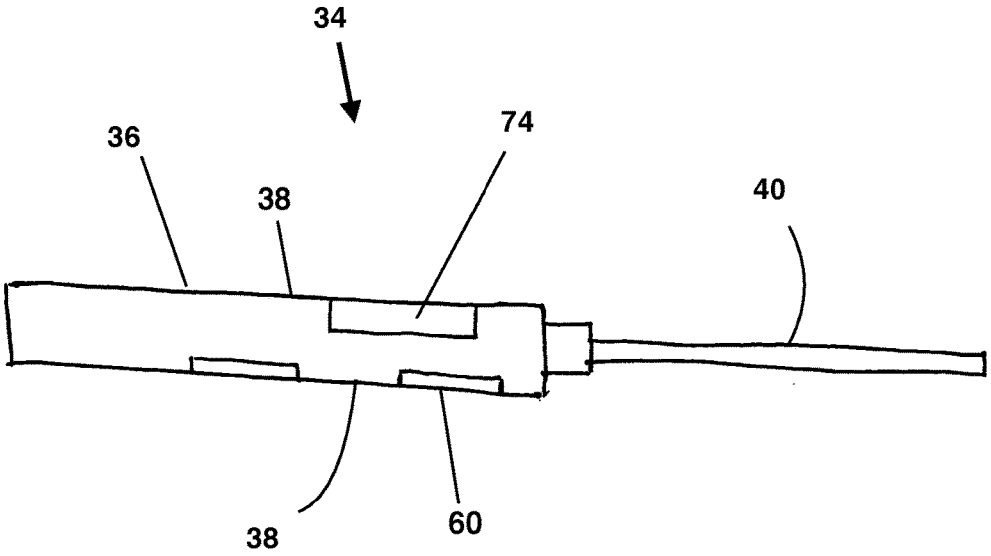
FIG. 5 is a side view of the insert of the invention.

FIGS. 5 through 13 depict the insert 34. FIG. 5 is a side view of an assembled insert 34, ready for insertion into the replica shell 30. The insert 34 includes an insert body 36.

The insert body 36 defines the receiver 38. An exhaust gas barrel 40 extends in a forward direction from the insert body 36.

Figure 6:
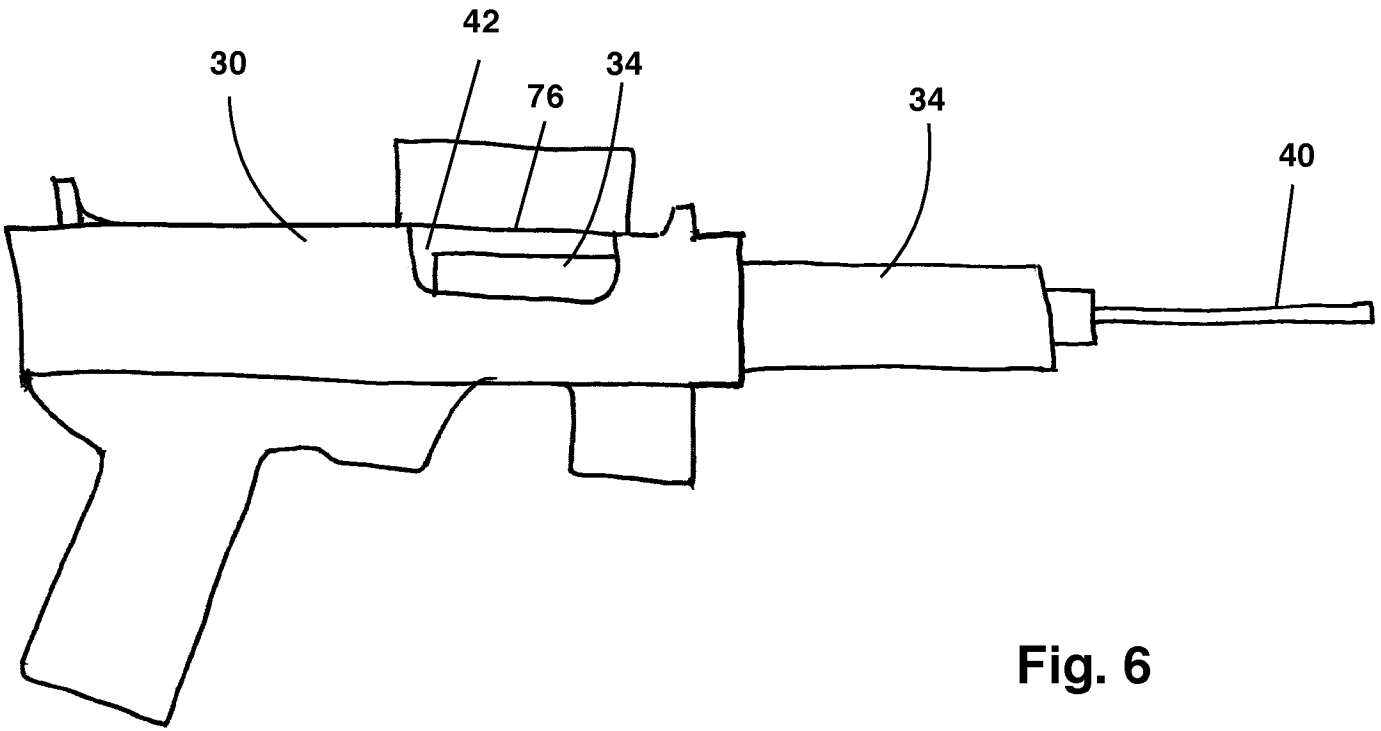
FIG. 6 is a side view of the insert partially inserted into the replica shell.

FIG. 6 shows the insert 34 partially inserted into the shell interior volume 42 of the replica shell 30. Insertion of the insert 34 into the replica shell 30 interior volume 42 from the front is particularly appropriate for an airsoft replica M3A1 submachine gun 26, but any other direction of insertion and any manner of enclosure of the insert 34 in the replica shell 30 interior volume 42 is contemplated by the Invention. For example, the replica shell 30 may be bifurcated into separable left and right portions, or into separable top and bottom portions, or may open at the rear, or may have other access to the shell interior volume 42 that allows insertion of an insert 34.

Figure 7:
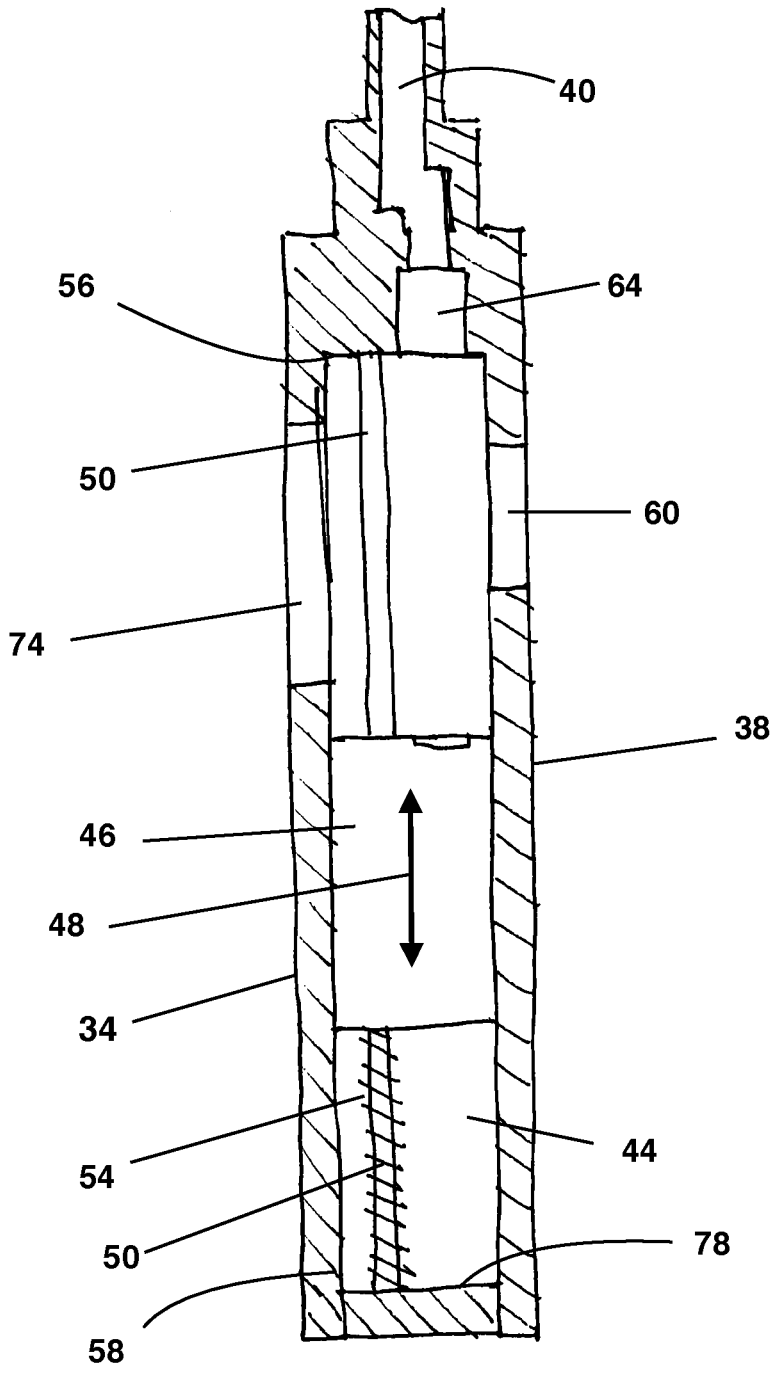
FIG. 7 is a side sectional view of the insert.
Figure 8:
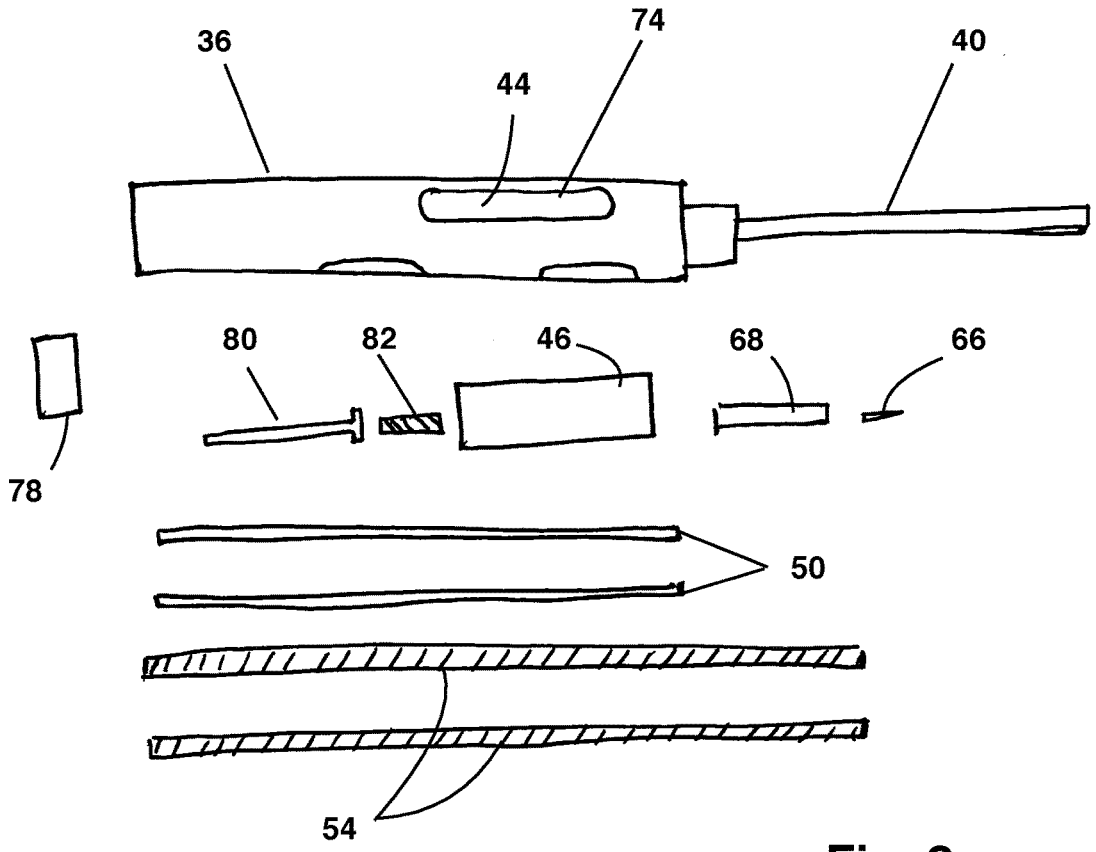
FIG. 8 is a view of the disassembled parts comprising the insert.
Figure 9:
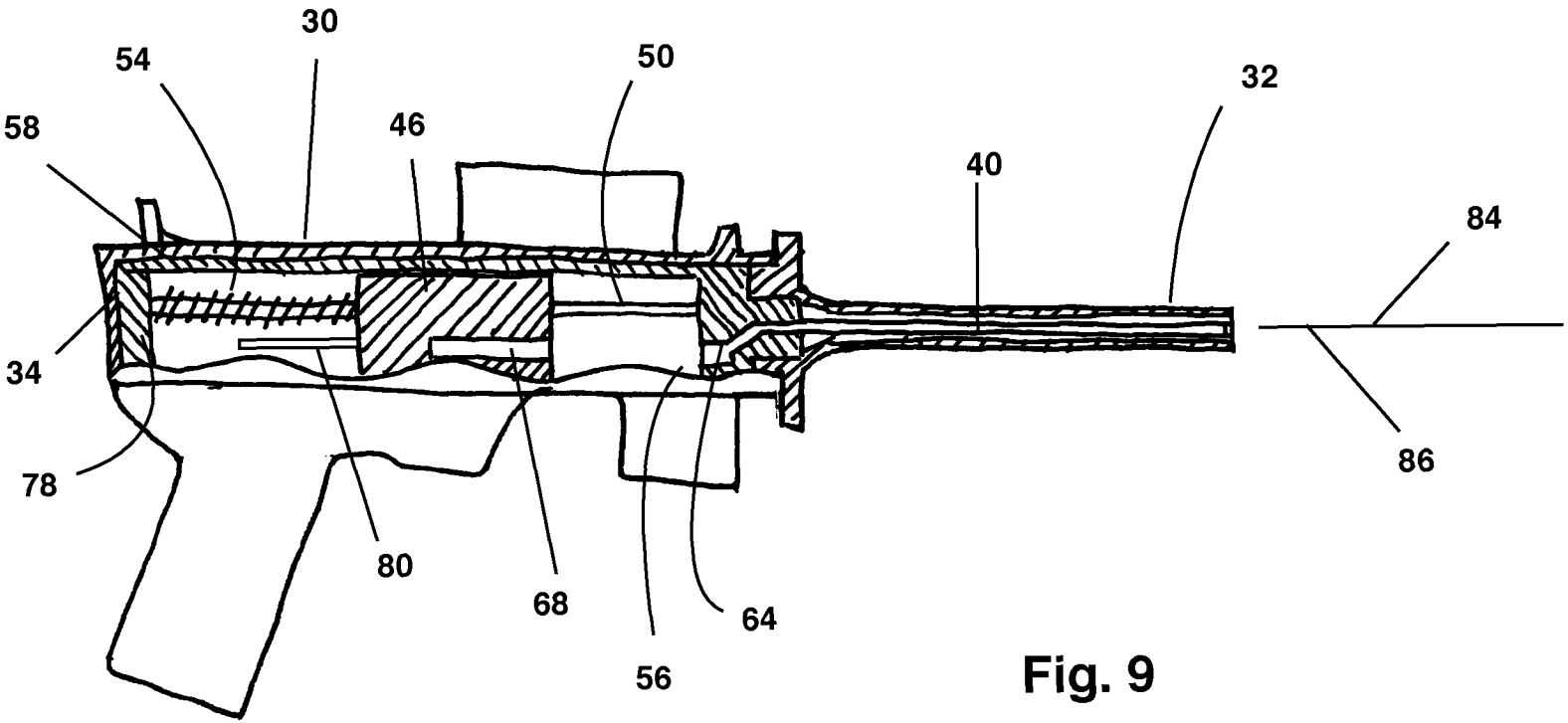
FIG. 9 is a cutaway sectional view of the replica shell and replica barrel with the insert installed.

FIG. 7 is a cross sectional side view of the insert 34 and FIG. 8 shows the disassembled parts of the insert 34. FIG. 9 is a partial cross-section cutaway showing the insert 34 in the replica shell 30 and replica barrel 32.

From FIGS. 7-9, the insert body 36 defines a receiver interior volume 44. The receiver interior volume 44 contains a bolt 46 configured for reciprocating motion in a longitudinal direction 48. The bolt 46 is in sliding engagement with one or more rods 50 that extend the length of the receiver interior volume 44. The rods 50 penetrate rod-receiving holes 52 that extend through the bolt 46. Springs 54 on the rods 50 urge the bolt 46 toward a second receiver end 56 from a first receiver end 58.

When the insert 34 is fully inserted in the replica shell 30, the magazine well 96 of the replica shell 30 aligns with the receiver magazine port 60 of the insert 34 so that the bolt 46 can strip blank cartridges from the blank-only magazine 62. The ejection port 74 of the insert 34 and of the replica shell 30 also align, all so that the Invention can receive, chamber, fire and eject blank cartridges in a realistic manner while not being able to fire a live round and not being readily converted to fire the live round.

The receiver 38 operates in a manner similar to an actual M3A1 submachine gun 2. When a trigger is depressed, the trigger causes a sear to release the bolt 46 from a cocked position proximal to the first end of the receiver 38. The trigger and sear are similar in construction and operation to that shown by FIG. 1 for the actual M3A1 submachine gun. Springs 54 urge the bolt 46 toward the receiver second end 56. The moving bolt 46 strips a blank cartridge from a blank-only magazine 62 at magazine port 60. The moving bolt 46 seats the blank cartridge in the chamber 64. The momentum of the moving bolt 46 causes a firing pin 66 at the bolt face to crush a primer of the blank cartridge, firing the blank cartridge. Exhaust gas from the fired blank cartridge travels through a fluid connection to the exhaust gas barrel 40, from which the exhaust gas, noise and flash discharge from the replica barrel 32.

The recoil from the firing blank cartridge propels the bolt 46 toward the first end 58 of the receiver 38. A cartridge-retaining assembly 68 mounted within the bolt 46 is aligned with the chamber 64. The cartridge-retaining assembly 68 includes an extractor 70 that grips the spent blank cartridge. The cartridge-retaining assembly is described below with respect to FIG. 18. The momentum of the bolt 46 pulls the spent blank cartridge from the chamber 64. As soon as the front end of the spent cartridge case clears the chamber 64, a spring-loaded ejector 72 rotates the spent cartridge case, freeing the spent cartridge case from the extractor 70 and propelling the spent cartridge case through the receiver ejection port 74 and the replica ejection port 76.

A recoil plate 78 is located at the receiver first end 58. When the bolt 38 approaches the end of its travel in the rearward direction, a recoil pin 80 mounted to and protruding from the back end of the bolt 46 contacts the recoil plate 78. The recoil pin 80 is in a sliding relationship with the bolt 46 and is spring-loaded by recoil spring 82. The spring rate of recoil spring 82 is greater than that of springs 54. When the recoil pin 80 on the moving bolt 46 contacts recoil plate 78, the motion of the bolt 46 compresses recoil spring 82, slowing and then reversing the rearward motion of the bolt 46. The recoil spring 82 and the springs 54 then propel the bolt 46 toward the second end 56 of the receiver 38. If the user releases the trigger, the sear retains the bolt 46 in the cocked position proximal to the first end 58 of the receiver 38. If the user keeps the trigger depressed the firing sequence repeats automatically until the magazine 62 is empty.

The recoil pin 80 and recoil spring 82 are not included in the actual M3A1 submachine gun 2. The purpose of the recoil pin 80 and spring 82 is to simulate the recoil of the actual M3A1 submachine gun 2. Because the blank cartridge does not accelerate a bullet, the recoil of a blank cartridge provides a different sensation to the user from that of a live round. The compression of the recoil spring 82 by the rearward-moving bolt 46 lengthens the duration of the push of the bolt 46 against the recoil plate 78, providing a more realistic experience to the user.

Figure 10:
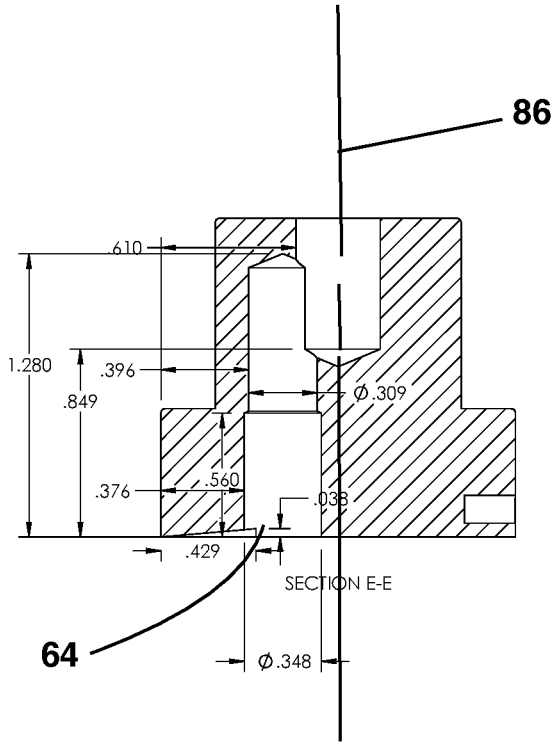
FIG. 10 is a sectional view of the chamber of the insert.
Figure 11:
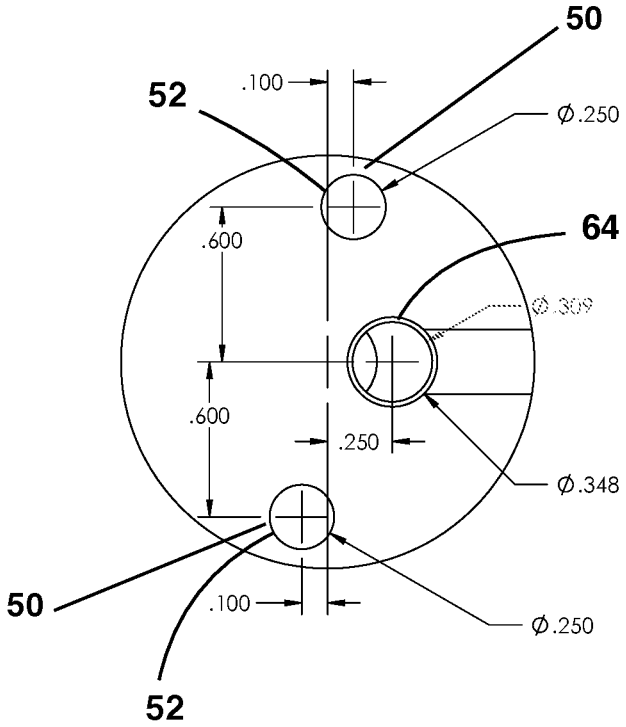
FIG. 11 is a front view of the chamber of the insert.

FIGS. 10 and 11 are a sectional view and an end view of the receiver second end 56. FIGS. 10 and 11 show the chamber 64 configured to receive a blank cartridge. FIGS. 10 and 11 show that the chamber 64 is misaligned with the longitudinal axis 86 of the exhaust gas barrel 40, preventing a live round fired in the chamber 64 from traveling down the exhaust gas barrel 40. FIG. 11 also shows the one or more rods 50 in end view.

Figure 12:
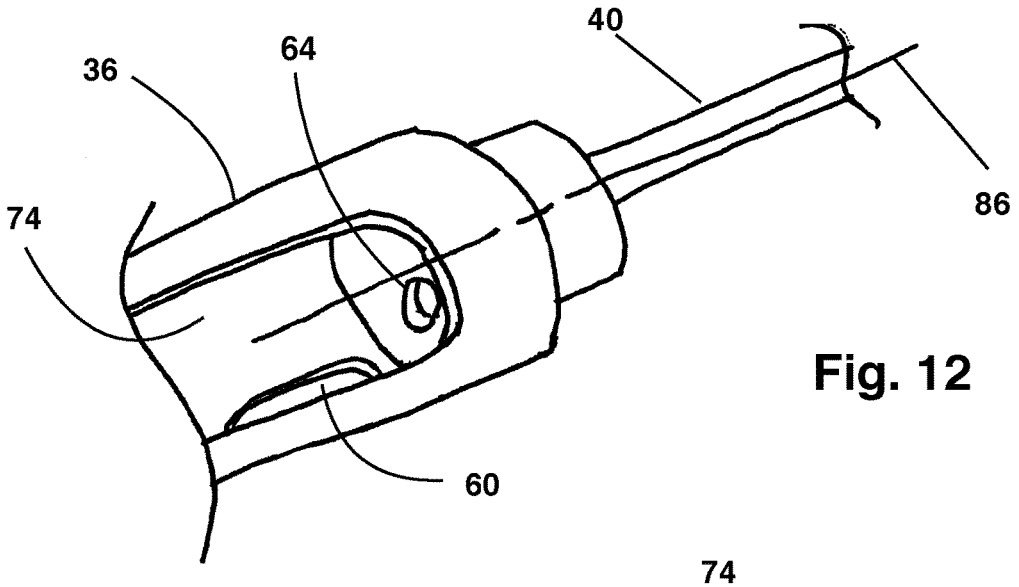
FIG. 12 is a detail perspective view of the chamber through the ejection port of the insert.

FIG. 12 is a detail perspective view of the chamber 64 viewed through the receiver ejection port 62 of the insert body 36. FIG. 12 illustrates that the chamber 64 is misaligned with exhaust gas barrel longitudinal axis 86 so that a live round fired in the chamber 64 cannot travel through the exhaust gas barrel 40.

Figure 13:
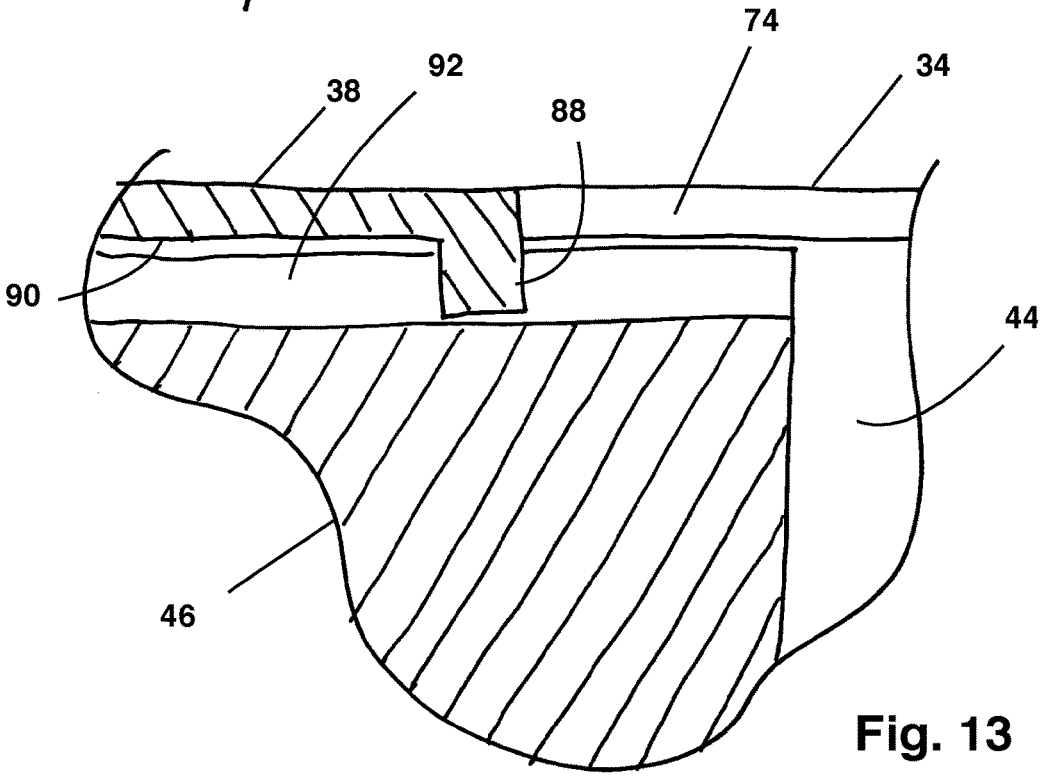
FIG. 13 is a detail sectional view of the bolt and body of the insert showing the boss and mating slot.

FIG. 13 is a detail sectional view of the assembled insert 34 at the receiver ejection port 74. A boss 88 depends from an interior wall 90 of the insert body 36 and extends into the receiver interior volume 44. The bolt 46 defines a slot 92 configured to receive the boss 88. The slot 92 allows reciprocating motion of the bolt 46 within the receiver interior volume 44 without interference between the boss 88 and the bolt 46. If a user attempts to convert the blank-only machine non-firearm 28 into an actual machinegun 2 by inserting an actual bolt 14 from an actual M3A1 submachine gun 2, the boss 88 will interfere with the actual bolt 14, preventing operation of the actual bolt 14. The actual bolt 14 also will not fit within the receiver interior volume 44 because a dimension of the receiver 38 is selected to interfere with the actual bolt 14. For example, the diameter, width or height of the receiver interior volume 44 may be selected so that the actual machinegun bolt 14 will not fit within the interior volume 44. Alternatively, the one or more rods 50 may be located so that they are not aligned with the holes through an actual machinegun bolt 14 or are of the wrong diameter to fit the actual machinegun bolt 14.

FIGS. 14, 15 and 16 illustrate the blank-only magazine 62 and magazine insert 94 of the blank-only machine non-firearm 28 of the Invention. The blank-only magazine 62 of the Invention will not accept a live round and the magazine well 96 of the replica shell 30 will not accept a magazine 10 from an actual M3A1 submachine gun 2. From FIG. 14, a magazine well insert 94 is affixed to the replica magazine well 96 of the replica shell 30 and configures the replica magazine well 96 to receive and retain a blank cartridge-only magazine 62. If a user were to remove the magazine well insert 94, as shown by the replica magazine well 96 on FIG. 15, the replica magazine well 96 would not retain an actual magazine 10 of an actual M3A1 submachine gun 2 because the actual retaining mechanism is missing. The modified magazine well would not allow the actual magazine 10 to feed live rounds to the insert 34. The blank-only magazine 62 is configured to resemble the actual M3A1 magazine 10 when the blank-only magazine 62 is installed in the magazine well insert 94 on the replica shell 30.

Critical dimensions of the replica shell 30, replica barrel 32, and insert 34 are selected to preclude substitution of parts from an actual M3A1 submachine gun 2. The replica barrel 30 cannot be exchanged for an actual barrel 6 and chamber 22 from an actual M3A1 submachine gun 2 because the threaded diameter of the replica shell 30 is too large to mate with the actual barrel 6. The actual bolt 14 of an actual M3A1 submachine gun 2 cannot be substituted for the bolt 46 of the Invention because the dimensions of the actual bolt 14 are too large to fit within the receiver interior volume 44.

Figure 17:
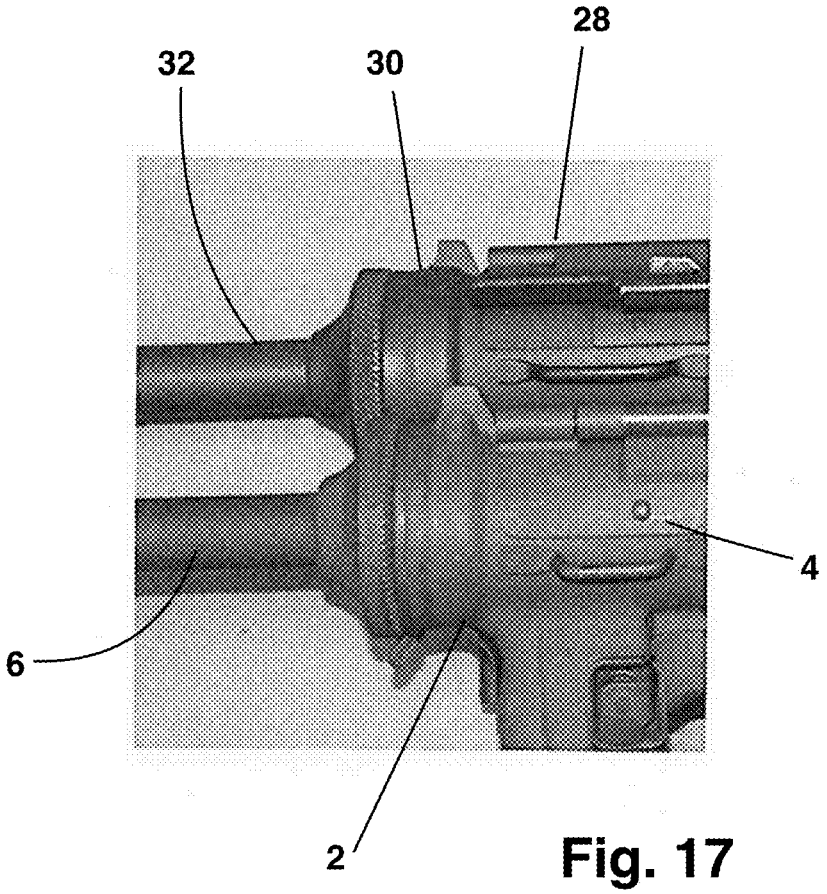
FIG. 17 is a color photograph showing the difference in length of the replica shell and the actual M3A1 submachine gun receiver to prevent the replica shell from being modified to fire live rounds.

As shown by FIG. 17, even if a person were to exchange the replica barrel 30 and chamber 50 of the Invention for the actual barrel 6 and chamber 22 of an actual M3A1 submachine gun 2 and if the person were able to fit the bolt 14 from an actual M3A1 submachine gun 2 into the insert 34, the Invention still would not fire a live round because the replica shell 30 of the Invention is slightly longer than the receiver 4 of the actual M3A1 submachine gun 2. At the forward limit of its travel, the bolt 14 of the actual M3A1 submachine gun would not contact the primer of the live round in the chamber 22 and hence the live round could not fire. This subtle difference in a critical dimension between the Invention and an actual M3A1 submachine gun 2 prevents ready conversion of the Invention to a functioning machinegun.

Figure 18:
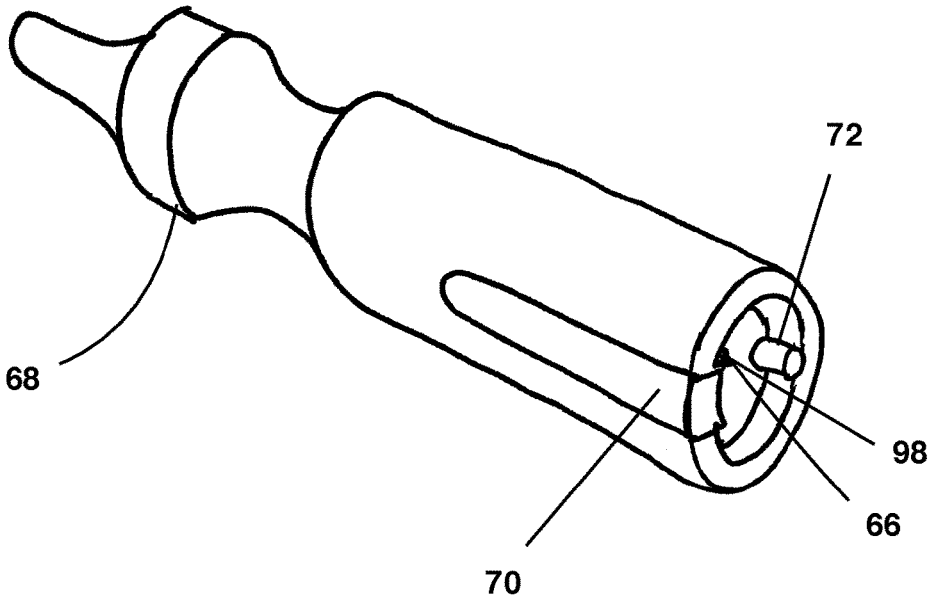
FIG. 18 is a perspective view of a cartridge-retaining assembly.

FIG. 18 is a perspective view of the modular cartridge retaining assembly 68. The firing pin 66, extractor 70 and ejector 72 are incorporated into a modular cartridge retaining assembly 68. The firing pin 66 is fixed in the firing pin opening 98 between the extractor 70 and ejector 72. The cartridge retaining assembly 68 shown by FIG. 18 is adapted from a bolt for an actual firearm, in this case an AR15 gas-operated rifle. The use of the AR-15 bolt substantially eases the process of manufacture of the cartridge retaining assembly 68 because the firing pin 66, extractor 70 and ejector 72 are already incorporated into the AR15 bolt. Any other suitable cartridge retaining assembly 68 is contemplated by the invention, including cartridge-retaining assemblies 68 adapted from other firearms. The cartridge retaining assembly 68 may be attached to the bolt 46 of the Invention by a pin, not shown. A hole penetrates both the bolt 46 and the cartridge retaining assembly 68. The pin passes through the hole and positively fixes the cartridge retaining assembly 68 to the bolt 46. This modular approach to the construction of the bolt 46 is particularly useful because the chamber 64 and the cartridge retaining assembly 68 are not aligned with the exhaust gas barrel longitudinal axis 86 and the insert 34, which otherwise would make the task of manufacturing the extractor 70, ejector 72 and firing pin opening 98 difficult.

The kit of the Invention includes components to convert a replica M3A1 submachine gun 26, either airsoft or otherwise, into the blank-only machine non-firearm 28 of the invention. The method of the Invention comprises the steps of installing the parts of the Invention to the replica shell 30 and replica barrel 32 of an airsoft or other replica M3A1 submachine gun 26. The apparatus, kit and method of the Invention are not limited to a replica M3A1 submachine gun 26 and may be applied to any suitable replica machinegun 26, whether airsoft or otherwise. The Invention specifically applies to a blank-only machine non-firearm 28 based on a replica MP 40 Maschinenpistole, on a replica Browning Automatic Rifle 1918, on a MP 44 Maschinepistole, or on any other replica machinegun 26. For use in replica machineguns 26 other than the M3A1, the insert 34 is configured to fit within the replica shell 30 and replica barrel 32 of the other replica machinegun 26. The operation of each of the reconfigured components is as described above.

LIST OF NUMBERED ELEMENTS

The following are the numbered elements identified in the specification and drawings:

2 actual M3A1 submachine gun
4 receiver of the actual M3A1
6 barrel assembly of the actual M3A1
8 magazine well of the actual M3A1
10 magazine of the actual M3A1
12 trigger assembly of the actual M3A1
14 bolt of the actual M3A1
16 guide rods of the actual M3A1
18 springs of the actual M3A1
20 ejection port cover
22 chamber of the actual M3A1
26 replica M3A1 submachine gun
28 blank-only machine non-firearm
30 replica shell
32 replica barrel
34 insert
36 insert body
38 receiver
40 exhaust gas barrel
42 a shell interior volume;
44 a receiver interior volume
46 bolt
48 longitudinal direction
50 one or more rods
52 holes through the bolt
54 springs
56 receiver second end
58 receiver first end
60 receiver magazine port
62 blank-only magazine
64 chamber
66 firing pin
68 cartridge-retaining assembly
70 extractor
72 ejector
74 receiver ejection port
76 replica ejection port
78 recoil plate
80 recoil pin
82 recoil spring
84 replica barrel longitudinal axis
86 exhaust gas barrel longitudinal axis
88 boss
90 interior wall
92 slot
94 magazine well insert
96 magazine well of the replica shell
98 firing pin opening

I claim:

1. A blank-only machine non-firearm, the blank-only machine non-firearm comprising:

a. a replica shell and a replica barrel of a replica machinegun, the replica shell and replica barrel providing an outward appearance of an actual machinegun, the replica shell defining a shell interior volume;

b. an insert, the insert having an insert body, the insert body being configured to be contained within the shell interior volume, the insert defining a receiver of the blank-only machine non-firearm, the receiver defining a longitudinal direction, the receiver defining a receiver interior volume;

c. the insert including a bolt contained within the receiver interior volume, the bolt having a configuration for reciprocating motion in the longitudinal direction;

d. the insert having a configuration to strip a blank cartridge from a magazine, to load the blank cartridge into a chamber, to fire the blank cartridge, to direct an exhaust gas from the fired blank cartridge through the replica barrel and to eject the fired blank cartridge from both a receiver ejection port defined by the receiver and a replica ejection port defined by the replica shell, whereby the replica shell and barrel define the outward appearance of the blank-only machine non-firearm while the insert allows the blank-only machine non-firearm to fire only blank cartridges.

2. The blank-only machine non-firearm of claim 1 wherein the receiver interior volume has a first receiver end distal to the barrel and a second receiver end proximal to the barrel, the configuration for reciprocating motion comprising:

a. one or more rods, the one or more rods being disposed in the receiver interior volume and extending in the longitudinal direction between the receiver first end and the receiver second end, the bolt having rod-receiving holes communicating through the bolt, the bolt being in sliding engagement with the one or more rods;

b. one or more springs disposed on the one or more rods, the one or more springs being configured to urge the bolt toward the second receiver end from the first receiver end;

c. a sear, the sear being configured to hold the bolt in a cocked position proximal to the first receiver end under the control of a trigger, the sear being configured to release the bolt when the trigger is depressed so that the bolt may move toward the second receiver end under the urging of the one or more springs.

3. The blank-only machine non-firearm of claim 1, further comprising: the insert defining an exhaust gas barrel, the exhaust gas barrel extending into the replica barrel, the exhaust gas barrel having an exhaust gas barrel longitudinal axis, the replica barrel defining a replica barrel longitudinal axis, the replica barrel longitudinal axis and the exhaust gas barrel longitudinal axis being substantially coextensive, whereby the exhaust gas barrel directs a flash and a noise from the firing blank cartridge through the replica barrel.

4. The blank-only machine non-firearm of claim 3 wherein the configuration of the insert to direct exhaust gas through the replica barrel further comprises: the chamber is misaligned with the exhaust gas barrel longitudinal axis and the replica barrel longitudinal axis, whereby if a live round is fired in the chamber a bullet cannot exit the chamber and cannot issue from the exhaust gas barrel or the replica barrel.

5. The blank-only machine non-firearm of claim 1 wherein the configuration of the bolt to strip the blank cartridge from a magazine, to load the blank cartridge in the chamber, to fire the blank cartridge and to eject the blank cartridge from the receiver comprising: a cartridge-retaining assembly, the cartridge-retaining assembly being mounted to the bolt, the cartridge-retaining assembly being aligned with the chamber, the cartridge-retaining assembly not being aligned with the exhaust gas barrel longitudinal axis or the replica barrel longitudinal axis.

6. The blank-only machine non-firearm of claim 5 wherein the receiver interior volume defines a first receiver end distal to the barrel and a second receiver end proximal to the barrel, the reciprocating motion of the bolt being between the first and second receiver ends, the cartridge-retaining assembly comprising:

a. a firing pin mounted to the cartridge-retaining assembly, the firing pin being configured to strike a primer of the blank cartridge when the bolt is moving toward the receiver second end from the receiver first end and the blank cartridge is seated in the chamber, b. an extractor, the extractor being configured to grip the case of the fired blank cartridge so that the bolt pulls the expended case from the chamber as the bolt is moving from the second end of the receiver toward the first end of the receiver;

c. an ejector, the ejector being configured to eject the expended case through the ejection ports of the receiver and the replica shell.

7. The blank-only machine non-firearm of claim 6 wherein the cartridge-retaining assembly is adapted from an actual firearm bolt.

8. The blank-only machine non-firearm of claim 7 wherein the actual firearm bolt is an AR15 bolt.

9. The blank-only machine non-firearm of claim 1 wherein the receiver has a configuration so that the receiver will not accept an actual machinegun bolt, whereby the receiver cannot be readily converted into an actual machinegun by substituting the bolt from the actual machinegun.

10. The blank-only machine non-firearm of claim 9 wherein the configuration of the receiver not to accept the actual machinegun bolt is that the receiver interior volume has a dimension, the dimension being less than a corresponding dimension of the actual machine gun bolt.

11. The blank-only machine non-firearm of claim 9 wherein the configuration of the insert not to accept the actual machinegun bolt comprises a boss extending from an interior wall of the receiver into the receiver interior volume, the bolt having a slot corresponding to the boss, the slot being configured to allow reciprocating movement of the bolt past the boss, the boss being configured to interfere with reciprocating movement of the actual machinegun bolt within the receiver interior volume.

12. The blank-only machine non-firearm of claim 1 wherein the configuration of the insert to strip the blank cartridge from the magazine comprises a magazine well insert, the magazine well insert being attached to the replica shell at a magazine well of the replica shell, the magazine well insert being configured so that the magazine well will not accept an actual magazine of the actual machinegun but will accept a blank-only magazine, whereby the receiver cannot load a live round even if the blank-only machine non-firearm is modified with an actual machinegun bolt and an actual machinegun barrel.

13. The blank-only machine non-firearm of claim 12 wherein the magazine well of the replica shell is configured not to retain the actual magazine of the actual machinegun if the magazine well is modified by removing the magazine well insert.

14. The blank-only machine non-firearm of claim 13, further comprising: the blank-only magazine configured to engage the magazine well insert, the blank-only magazine being configured to hold and feed a plurality of the blank cartridges when the blank-only magazine is in engagement with the magazine well insert, the blank-only magazine being configured to resemble the actual magazine when the blank-only magazine is in engagement with the magazine well insert.

15. The blank-only machine non-firearm of claim 1 wherein the replica shell and replica barrel are configured for releasable engagement, the replica shell being configured so that an actual machine gun barrel cannot be in engagement with the replica shell, whereby the blank-only machine non-firearm cannot be modified to fire live rounds through the actual machinegun barrel.

16. The blank-only machine non-firearm of claim 15 wherein the replica shell defines threads having a diameter configured for engagement with the replica barrel, the diameter being too large for threaded engagement with the actual machine gun barrel, whereby the actual machine gun barrel cannot me mounted to the replica shell.

17. The blank-only machine non-firearm of claim 1 wherein the replica shell defines a length that is greater than a corresponding length of the actual machine gun, whereby if the blank-only machine non-firearm is modified with an actual bolt, an actual barrel and an actual magazine of the actual machine gun, the modified blank-only machine non-firearm cannot fire live rounds because a firing pin on the actual bolt will not reach a primer of the live round.

18. The blank-only machine non-firearm of claim 1 wherein the actual machinegun is an M3A1 machinegun.

19. The blank-only machine non-firearm of claim 1 wherein the replica shell is from one of an airsoft replica M3A1 machinegun, an airsoft replica MP 40 Maschinenpistole, an airsoft replica Browning Automatic Rifle 1918, and an airsoft replica MP 44 Maschinepistole.

20. A method of making a blank-only machine non-firearm, the method comprising:

a. providing a replica shell and a replica barrel of a non-firing replica machinegun, the replica machinegun resembling an actual machinegun, the replica shell defining a shell interior volume;

b. providing an insert having an insert body, the insert body being configured to fit within the shell interior volume, the insert body defining a receiver for the blank-only machine non-firearm;

c. inserting the insert body into the shell interior volume, whereby the receiver is contained within the shell interior volume and has the appearance of the actual machinegun;

d. providing an exhaust gas barrel, the exhaust gas barrel being attached to the receiver, the receiver defining a chamber configured to receive a blank cartridge, the chamber being configured to generate an exhaust gas upon firing of the blank cartridge in the chamber, the chamber being in fluid communication with the exhaust gas barrel, the exhaust gas barrel being disposed within the replica barrel when the insert is inserted into the replica shell, the exhaust gas barrel and the replica barrel being misaligned with the chamber, whereby a flash and a noise from the blank cartridge are conveyed from the chamber through the exhaust gas barrel and through the replica barrel and whereby a live round fired in the chamber cannot propel a bullet down the exhaust gas barrel and the replica barrel.

* * * * *